US005370603A

United States Patent [19]

Newman

[11] Patent Number: 5,370,603

[45] Date of Patent: Dec. 6, 1994

[54] PNEUMATIC CPR GARMENT

[75] Inventor: George H. Newman, Niceville, Fla.

[73] Assignee: The United States of America as represented by the Secretary of the Air Force, Washington, D.C.

[21] Appl. No.: 22,224

[22] Filed: Feb. 25, 1993

[51] Int. Cl.[5] ..... A61H 31/00

[52] U.S. Cl. ..... 601/41; 601/151; 601/150

[58] Field of Search ..... 601/41, 43, 44, 148, 601/149, 150, 151, 152, 153, 9, 11; 128/204.18, 204.21

[56] References Cited

U.S. PATENT DOCUMENTS

| | | | |
|---|---|---|---|
| 3,683,655 | 8/1972 | White | 128/30.2 |
| 3,866,604 | 2/1975 | Curless et al. | 128/64 |
| 4,270,527 | 6/1981 | Peters et al. | 128/87 R |
| 4,349,015 | 9/1982 | Alferness | 128/28 |
| 4,397,306 | 8/1983 | Weisfeldt | 128/28 |
| 4,424,806 | 1/1984 | Newman | 128/28 |
| 4,583,522 | 4/1986 | Aronne . | |
| 4,674,479 | 6/1987 | Jennings et al. . | |
| 4,928,674 | 5/1990 | Halperin | 128/28 |
| 4,959,047 | 9/1990 | Tripp, Jr. | 600/19 |

FOREIGN PATENT DOCUMENTS

| | | | |
|---|---|---|---|
| 2448344 | 10/1980 | France | 128/28 |
| 2140694 | 12/1984 | United Kingdom | 128/28 |

*Primary Examiner*—Robert A. Hafer
*Assistant Examiner*—David J. Kenealy
*Attorney, Agent, or Firm*—Bobby D. Scearce; Thomas L. Kundert

[57] ABSTRACT

A system for pneumatically controlling the blood circulation in the lower body extremities in enhancing effectiveness of cardiopulmonary resuscitation on a subject is described which comprises an inflatable garment for covering a preselected portion of the lower body and legs of a subject, a source of pressurized air operatively connected to the garment through a control valve configured for controllably deflating and inflating the garment in response to the application and removal of cardiopulmonary resuscitation pressure applied to a sensor disposed on the chest of a subject.

6 Claims, 3 Drawing Sheets

PNEUMATIC CPR GARMENT

RIGHTS OF THE GOVERNMENT

The invention described herein may be manufactured and used by or for the Government of the United States for all governmental purposes without the payment of any royalty.

BACKGROUND OF THE INVENTION

The present invention relates generally to systems and garments for externally controlling blood flow in the body, and more particularly to a system for electrically or pneumatically controlling blood circulation utilizing inflatable bladders applied to the lower body extremities in enhancing the effectiveness of cardiopulmonary resuscitation (CPR) on a subject.

Standard CPR techniques have typically been characterized by only about 5–20 percent of normal blood flow to the heart during CPR application and a survival rate of CPR recipients of only about 15 percent.

The invention solves or substantially reduces in critical importance problems with existing CPR techniques by providing a system for enhancing effectiveness of CPR performed on a subject by enhancing blood flow to and from the heart during CPR. The invention includes an inflatable garment for covering preselected portions of the lower body and legs of the subject, a source of pressurized air, a sensor responsive to the application of CPR pressure for placement on the chest of the subject, and a valve interconnecting the air source and garment and responsive to the sensor for rapid deflation of the garment during application of CPR pressure and rapid inflation of the garment upon removal of the CPR pressure.

The invention has application in the enhancement of survivability of subjects requiring CPR, and may be incorporated into any facility where CPR activity may be used, such as a hospital intensive care unit, emergency room or operating room, fire department, ambulance rescue unit or field medic unit. The invention may be adapted for hands-off operation by activation by a signal from an electrocardiagraph.

It is therefore a principal object of the invention to provide an improved garment for controlling blood flow in the body.

It is a further object of the invention to provide an electrically or pneumatically operated system and garment for controlling blood flow in the body.

It is a yet another object of the invention to provide an electrically or pneumatically operated system and garment for assisting the application of CPR to a subject These and other objects of the invention will become apparent as a detailed description of representative embodiments proceeds.

SUMMARY OF THE INVENTION

In accordance with the foregoing principles and objects of the invention, a system for pneumatically controlling the blood circulation in the lower body extremities in enhancing effectiveness of cardiopulmonary resuscitation on a subject is described which comprises an inflatable garment for covering a preselected portion of the lower body and legs of a subject, a source of pressurized air operatively connected to the garment through a control valve configured for controllably deflating and inflating the garment in response to the application and removal of cardiopulmonary resuscitation pressure applied to a sensor disposed on the chest of a subject.

DESCRIPTION OF THE DRAWINGS

The invention will be more clearly understood from the following detailed description of representative embodiments thereof read in conjunction with the accompanying drawings wherein.

Figure 1:
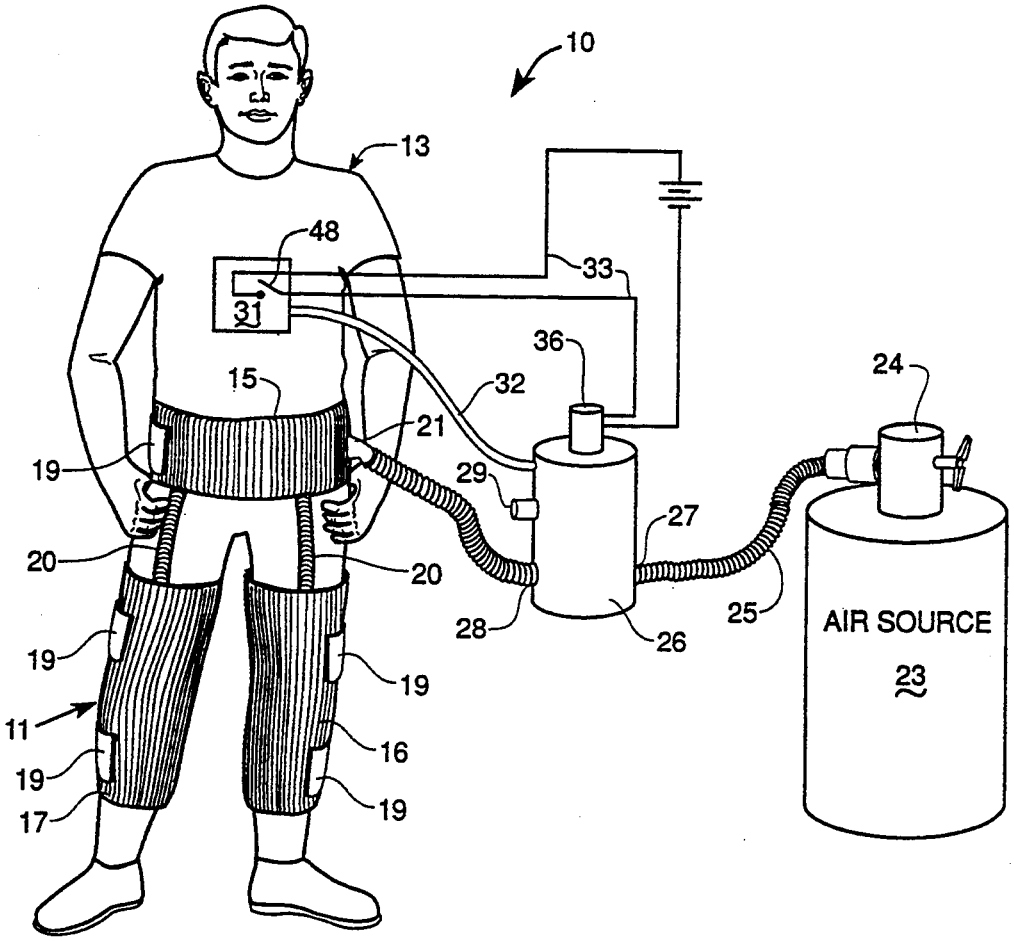
FIG. 1 is a schematic of a representative embodiment of the invention including alternative electrical or pneumatic sensors for low pressure operation for both inflation and deflation modes.
Figure 3:
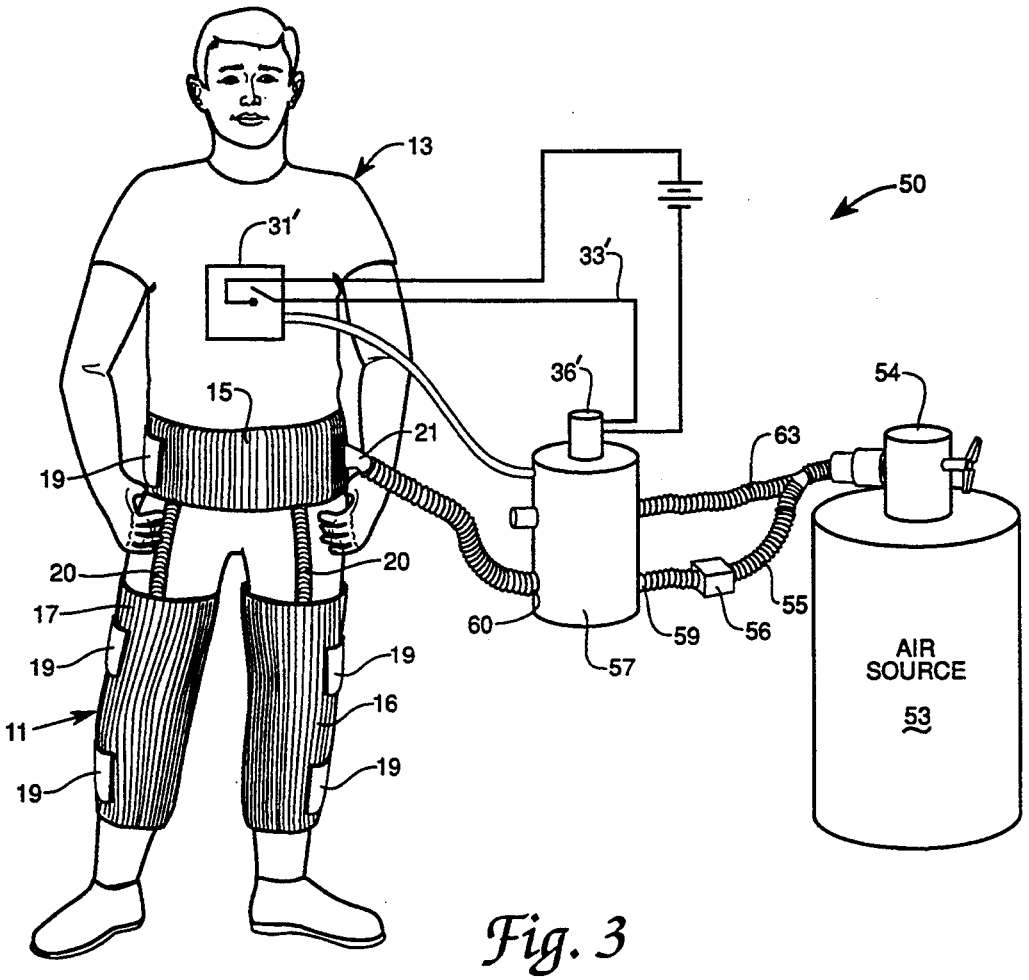
Figure 5:
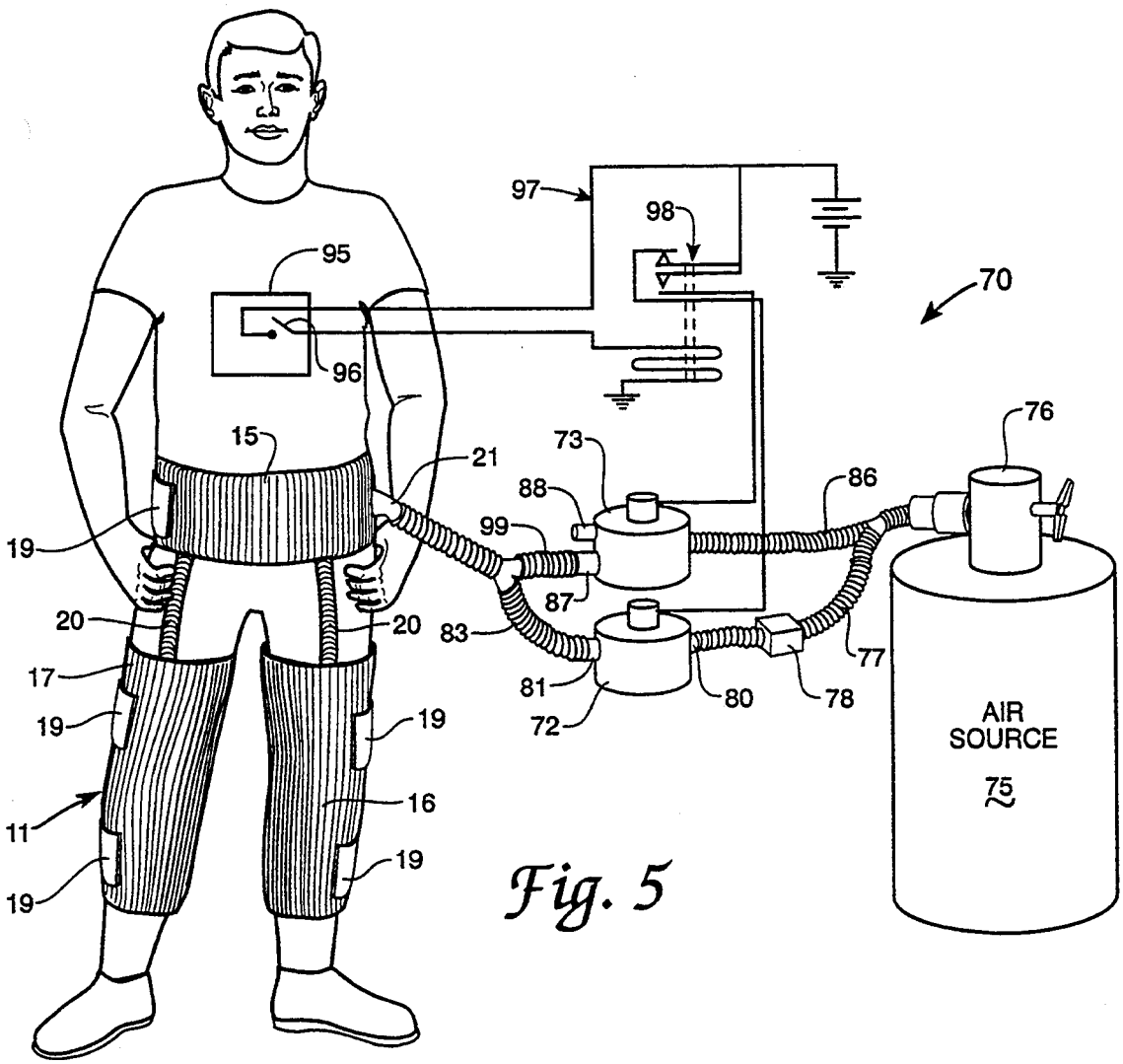

FIGS. *2a, 2b* are axial sectional views of the control valve for the FIG. 1 embodiment in respective deflate and inflate modes;

FIG. 3 is a schematic of another embodiment of the invention in a configuration for high pressure assist of the deflation mode;

FIGS. *4a, 4b* are axial sectional views of the control valve for the FIG. 3 embodiment in respective deflate and inflate modes; and FIG. 5 is a schematic of another embodiment of the invention including separate inflate and deflate valves with high pressure assist of the deflation mode, and, FIG. *5a* is an enlarged schematic sectional view of the valve of the FIG. 5 system.

DETAILED DESCRIPTION

Referring now to the drawings, FIG. 1 is a schematic of system 10 in one representative embodiment of the invention for electrically or pneumatically controlled low pressure operation. System 10 includes an inflatable garment 11 (e.g., inflatable pants) for covering any preselected portion of the lower body and legs of a subject 13, such as illustrated in FIG. 1 as including one or more inflatable bladders 15, 16, 17 wrapped around and covering the legs and intestinal region of subject 13, held in place by suitable fastening means such as Velcro TM fasteners 19, and pneumatically interconnected as by conduits 20. Garment 11 includes inlet/outlet 21 for rapid inflation/deflation of bladders 15, 16, 17 in the operation of system 10 as described more fully below. Source 23 of pressurized air is operatively connected to garment 11 through conventional (about 15 psig) regulator 24, conduit 25 and control valve 26. Control valve 26 includes inlet 27 and outlet 28 for controllably conducting air from source 23 to bladders 15, 16, 17, and an exhaust port 29 for controllably exhausting air from bladders 15, 16, 17 in operation of the invention as described below. Valve 26 is operatively connected to and controlled by sensor 31, and may in alternative embodiments of the invention be a pneumatically controlled valve as through pneumatic line 32 from a pneumatically operated sensor, or an electrically controlled valve as through electrical circuitry 33. Operation of valve 26 is discussed below in relation to FIGS. *2a, 2b.*

Figure 2A:
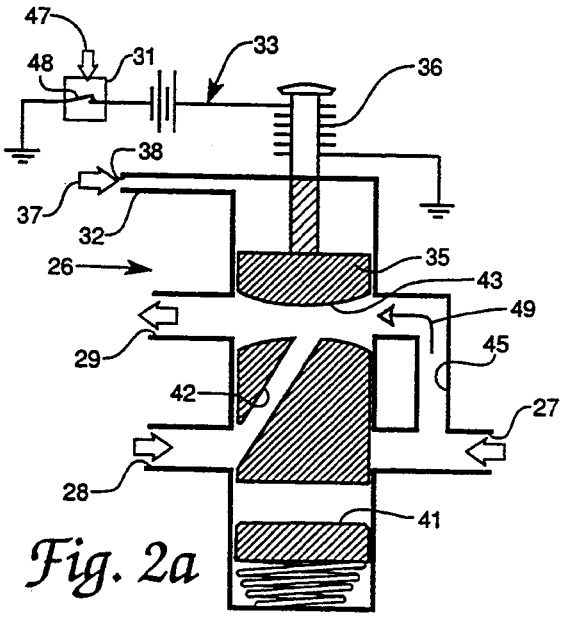
Figure 2B:
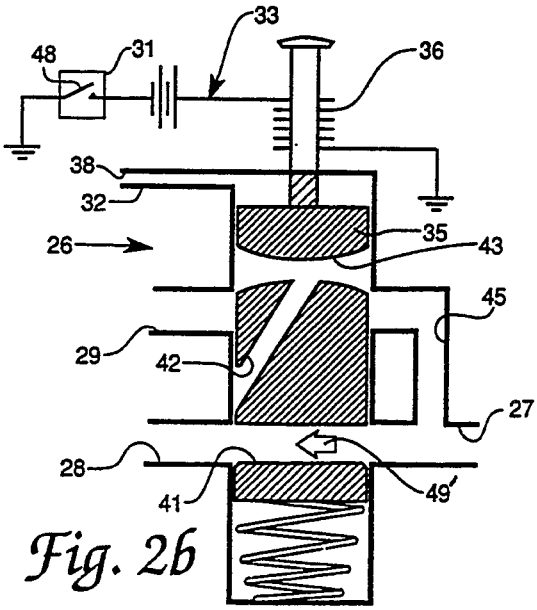

Referring now additionally to FIGS. *2a* and *2b,* shown therein are axial sectional views of control valve 26 in deflate (closed) and inflate (open) modes, respectively. For purposes of illustration, FIGS. *2a* and *2b* show structure defining both electrical and pneumatic control; in practicing the invention, either electrical control or pneumatic control would be selected. Valve 26 includes plunger 35 controllably movable axially in response to energizing solenoid 36 or in response to a pneumatic pulse 37 at inlet 38. Plunger 35 has passageways 41, 42, 43 defined therein for controllably directing flow of pressurized air from source 23 into bladders 15, 16, 17 in the inflate mode (FIG. 2*b*) or through bypass 45 to exhaust 29 in the deflate mode (FIG. 2*a*). Sensor 31 is disposed on the chest of subject 13 at a point where CPR pressure is applied. Upon application of CPR pressure 47, switch 48 (of the electrically controlled embodiment) is closed, solenoid 36 is energized (or pulse 37 is applied in the pneumatically controlled embodiment) and plunger 35 is displaced as shown in FIG. 2a. At the displaced position for plunger 35 shown in FIG. 2*a*, bladders 15, 16, 17 are deflated through passageways 42,43 and exhaust 29; rapid deflation of bladders 15, 16, 17 may be assisted by the venturi effect generated by flow 49 of pressurized air through bypass 45 and venturi shaped passageway 43. With bladders 15, 16, 17 deflated, blood flow in the lower extremities of subject 13 is substantially unrestricted. When CPR pressure 47 is removed, plunger 35 is released to return to the FIG. 2*b* position at which pressurized air flow 49' is conducted to, and rapidly inflates, bladders 15, 16, 17. Inflation of bladders 15, 16, 17 applies pressure to covered lower extremities of subject 13 and forces blood flow toward the heart preparatory to the next and subsequent applications of pressure 47 to the chest of subject 13. It is important that bladders 15, 16, 17 deflate rapidly in the deflate mode so as not to impede blood flow from the heart upon subsequent CPR pressure 47 application(s). Repeated cycles of alternate applications of pressure 47 with attendant rapid deflation of bladders 15, 16, 17 and release of pressure 47 with attendant rapid inflation of bladders 15, 16, 17 significantly increases effectiveness of CPR application, enhances survivability of a subject undergoing CPR, and enhances blood flow to the heart for a subject in a state of shock.

Referring now to FIG. 3, shown schematically therein is system 50 of the invention wherein high pressure assist is utilized for rapid deflation of bladders 15, 16, 17. As with system 10 of FIG. 1, system 50 includes garment 11 including one or more inflatable bladders 15, 16, 27 having inlet/outlet 21, and held in place on subject 13 by fasteners 19 and pneumatically interconnected as by conduits 20. A source 53 of high pressure (100 psig) air is operatively connected to garment 11 through conventional high pressure (about 100 psig) regulator 54, conduit 55, low pressure (15 psig) regulator 56, and control valve 57. Valve 57 includes inlet 59 and outlet 60 for conducting low pressure air from regulator 56 and source 53 to bladders 15, 16, 17, inlet 62 for conducting high pressure air from source 53 through conduit 63, and exhaust port 65 for controllably exhausting air from bladders 15, 16, 17. Valve 57 is operatively connected to and controlled by sensor 31', substantially identically to the FIG. 1 system, for electrical control utilizing circuitry 33' and solenoid 36' or for pneumatic control utilizing pneumatic line 32' operatively connected to inlet 38'.

Figure 4A:
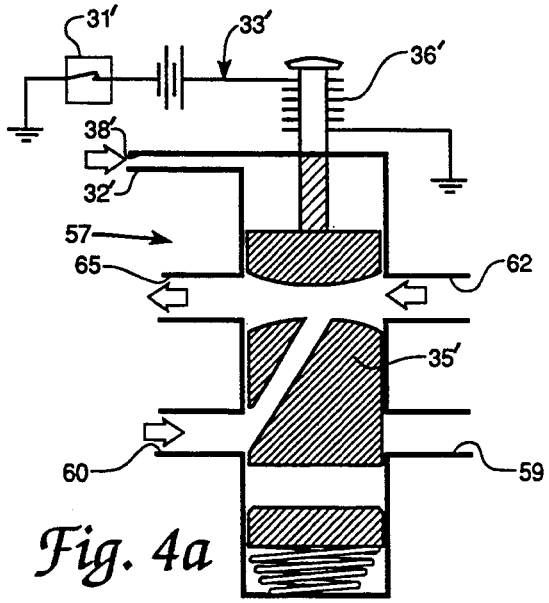
Figure 4B:
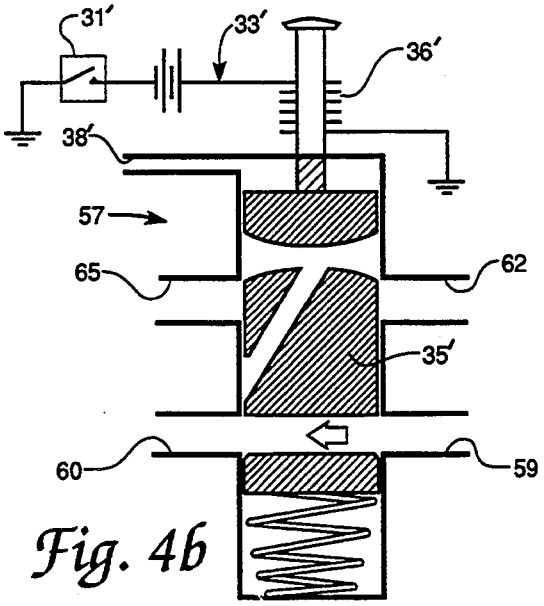

FIGS. 4*a* and 4*b* show axial sectional views of control valve 57 in deflate (closed) and inflate (open) modes, respectively, similarly to the presentation of valve 26 of FIG. 1. The structure and operation of valve 57 and plunger 35' are the same as that of valve 26 and plunger 35 except that instead of bypass 45 in valve 26, inlet 62 is provided for connection of valve 57 to high pressure conduit 63. The interaction of valve 57 and sensor 31' is substantially identical to that of valve 26 and sensor 31 of FIG. 1. However, in the operation of valve 57 in the deflate mode as illustrated in FIG. 4a, high pressure (100 psig) air is directed through the venturi of passageway 43 for substantially more rapid deflation of bladders 15, 16, 17 than obtains with the FIG. 1 system.

Referring now to FIG. 5, shown schematically therein is system 70, representative of yet another embodiment of the invention, including separate inflate and deflate valves with high pressure assist of the deflation mode. As in systems 10 and 50, system 70 includes garment 11 and one or more inflatable bladders 15, 16, 17 having inlet/outlet 21, fasteners 19 and connecting conduits 20. However, in order to obtain a more rapid response characteristic of electrical control in the inflation and deflation of bladders 15, 16, 17 as compared to pneumatic control, system 70 includes two electrically operated control valves 72, 73 respectively controlling inflation and deflation of bladders 15, 16, 17. Each valve 72, 73 may have substantially conventional solenoid controlled open/closed structure and function, except that valve 73, as described more fully below, preferably has a venturi shaped passageway 92 similar to passageway 43 of valves 26,57 to assist deflation of bladders 15, 16, 17.

Figure 5A:
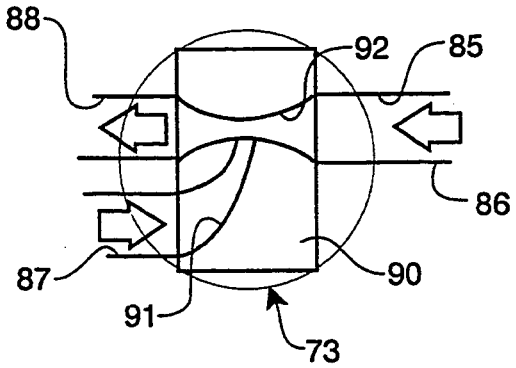

Similarly to system 50, source 75 of high pressure (e.g., 100 psig) air is operatively connected to garment 11 through conventional high pressure (about 100 psig) regulator 76, conduit 77, low pressure (about 15 psig) regulator 78 and valve 72. Valve 72 includes inlet 80 and outlet 81 for conducting low pressure air through branched conduit 83 to bladders 15, 16, 17. Valve 73 (see enlarged view of valve 73 presented in FIG. 5*a*) has first inlet 85 for conducting high pressure air from source 75 through conduit 86, second inlet 87 for conducting air from bladders 15, 16, 17 through branched conduit 83, and outlet 88 for controllably exhausting air from the bladders. Plunger 90 of valve 73 includes first passageway 91 communicating with inlet 87 and passageway 92 in the form of a venturi for conducting high pressure air from inlet 85 to exhaust port 88 in exhausting bladders 15, 16, 17 using the venturi effect similarly to the operation of valves 26, 57.

Both valves 72, 73 are operatively connected to and controlled by sensor 95 having sensor switch 96 within electrical circuit 97 including relay 98, the respective contacts of which are operatively connected to corresponding solenoids of valves 72, 73. In the operation of system 70, inflation valve 72 is activated to conduct air to bladders 15, 16, 17 when no CPR pressure is applied to sensor 95. Upon the application of CPR pressure, switch 96 is closed and relay 98 is activated, which activation closes inflation valve 72 and opens deflation valve 73. High pressure air is thereby conducted through valve 73 for high pressure assist of the deflation of bladders 15, 16, 17 through branch 99 of branched conduit 83. Removal of CPR pressure deactivates relay 98 and returns valves 72, 73 to the respective positions thereof prior to application of pressure. Repeated cycles of application and removal of CPR pressure and the attendant deflation and inflation of bladders 15, 16, 17 provide the desired enhancement of blood flow in manner similar to that described above in relation to the FIG. 1 embodiment.

The invention therefore provides a system for electrically or pneumatically controlling blood circulation utilizing inflatable bladders applied to the lower body extremities in enhancing the effectiveness of CPR on a subject. It is understood that modifications to the invention may be made, as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A system for enhancing blood flow to and from the heart during the application of cardiopulmonary resuscitation to a subject, comprising:

(a) a source of pressurized air;

(b) an inflatable garment for covering preselected portions of the lower body and legs of a subject;

(c) means for sensing the application of cardiopulmonary resuscitation pressure from an external source to the chest of said subject and for providing an output signal in response to said application of said cardiopulmonary resuscitation pressure, said means for sensing comprises a pressure sensor configured for placement between the chest of the subject and the source of external pressure; and (d) valve means and conduit means operatively interconnecting said source and said garment, said valve means operatively connected to said means for sensing for rapidly deflating said garment in response to said output signal during application of said cardiopulmonary resuscitation pressure and for rapidly inflating said garment with air from said source upon removal of said cardiopulmonary resuscitation pressure.

2. The system of claim 1 wherein said valve means includes an electrically controlled solenoid valve.

3. A system for enhancing blood flow to and from the heart during the application of cardiopulmonary resuscitation to a subject, comprising:

(a) a source of pressurized air;

(b) an inflatable garment having an inlet and comprising at least one inflatable bladder for covering preselected portions of tile lower body and legs of a subject;

(c) means for sensing the application of cardiopulmonary resuscitation pressure from an external source to the chest of said subject and for providing an output signal in response to said application of said cardiopulmonary resuscitation pressure, said means for sensing comprises a pressure sensor configured for placement between the chest of the subject and the source of external pressure; and (d) electrically controlled solenoid valve means and conduit means operatively interconnecting said source and said inlet of said garment, said valve means operatively connected to said means for sensing for rapidly deflating said bladder in response to said output signal during application of said cardiopulmonary resuscitation pressure and for rapidly inflating said bladder with air from said source upon removal of said cardiopulmonary resuscitation pressure.

4. The system of claim 4 wherein said valve means includes an inlet for connection to said source, an outlet for connection to said inlet of said garment, and an exhaust port, and an axially movable plunger operatively connected to a solenoid, said plunger being movable between first and second positions in response to said output signal, said plunger having a first passageway for conducting air from said inlet of said valve means to said outlet at said first position, a second passageway having the shape of a venturi for conducting air from said inlet of said valve means to said exhaust port at said second position, and a third passageway for conducting air from said outlet to said second passageway at said second position.

5. A system for enhancing blood flow to and from the heart during the application of cardiopulmonary resuscitation to a subject, comprising:

(a) a source of pressurized air;

(b) an inflatable garment having an inlet and comprising at least one inflatable bladder for covering preselected portions of the lower body and legs of a subject;

(c) means for pneumatically sensing the application of cardiopulmonary resuscitation pressure from an external source to the chest of said subject, and for providing a pneumatic pulse in response to said application of cardiopulmonary resuscitation pressure said means for pneumatically sensing comprises a pneumatic pressure sensor configured for placement between the chest of the subject and the source of external pressure; and (d) pneumatically controlled valve means and conduit means operatively interconnecting said source and said inlet of said garment, said valve means operatively connected to said means for pneumatically sensing for rapidly deflating said bladder in response to said pulse during application of said cardiopulmonary resuscitation pressure and for rapidly inflating said bladder with air from said source upon removal of said cardiopulmonary resuscitation pressure.

6. The system of claim 5 wherein said valve means includes an inlet for connection to said source, an outlet for connection to said inlet of said garment, and an exhaust port, and an axially movable plunger operatively connected to said means for pneumatically sensing for movement between first and second positions in response to said pulse, said plunger having a first passageway for conducting air from said inlet of said valve means to said outlet at said first position, a second passageway having the shape of a venturi for conducting air from said inlet of said valve means to said exhaust port at said second position, and a third passageway for conducting air from said outlet to said second passageway at said second position.

* * * * *